US006332605B1

(12) United States Patent
Johansson

(10) Patent No.: US 6,332,605 B1
(45) Date of Patent: Dec. 25, 2001

(54) REVERSIBLE DOCUMENT MANIPULATING DEVICE

(75) Inventor: Anders Johansson, Mörbylånga (SE)

(73) Assignee: Kalmarmailpro AB, Kalmar (SE)

( * ) Notice: Subject to any disclaimer, the term of this patent is extended or adjusted under 35 U.S.C. 154(b) by 0 days.

(21) Appl. No.: 09/664,307

(22) Filed: Sep. 18, 2000

Related U.S. Application Data

(63) Continuation of application No. PCT/SE99/00424, filed on Mar. 18, 1999.

(30) Foreign Application Priority Data

Mar. 18, 1998 (SE) ..... 9800899

(51) Int. Cl.[7] ..... B65H 29/60

(52) U.S. Cl. ..... 270/58.23; 270/58.06; 270/52.16; 53/284.3

(58) Field of Search ..... 198/371.1, 371.2, 198/371.3; 270/52.46, 52.24, 58.24, 52.18, 58.06, 58.23; 412/10, 11; 53/284.3, 55, 569

(56) References Cited

U.S. PATENT DOCUMENTS 2,572,325 * 10/1951 Ernst ..... 198/371.2
4,541,824 * 9/1985 Muller ..... 198/371.2 X
4,805,384 * 2/1989 DePasquale et al. ..... 53/569
4,924,652 * 5/1990 Kraususki et al. ..... 53/55
5,000,657 3/1991 Gunther, Jr. .
5,561,963 10/1996 Sytema et al. .
5,678,813 * 10/1997 Osako et al. ..... 270/52.16

FOREIGN PATENT DOCUMENTS 0 556 922 8/1993 (EP) .
0 615 864 9/1994 (EP) .
2 134 891 8/1984 (GB) .

* cited by examiner

*Primary Examiner*—Christopher P. Ellis
*Assistant Examiner*—Patrick Mackey
(74) *Attorney, Agent, or Firm*—Browdy and Neimark

(57) ABSTRACT

A document handling device (12) comprises a first endless conveyor (6), which is arranged to be intermittently driven in a first direction of feed (F) and has drivers to fetch documents (2) at document discharging stations (5) and put them together into sheaves (3). The documents are to be manipulated, downstream of the document discharging stations (5) seen in the direction of feed (F), in sheaves at a first sheaf discharging station (8), such as a document manipulating unit, in which the sheaves of documents (3) from the first conveyor (6) are inserted into envelopes (4) placed on a second endless conveyor (9), which is parallel to the first conveyor (6) and driven synchronously therewith. The first conveyor (6) is intermittently drivable also in a second direction opposite to said first direction of feed and a second sheaf discharging station (14), such as a stapling or plastics coating unit, is arranged upstream of the document discharging stations (5) seen in said first direction of feed (F).

7 Claims, 5 Drawing Sheets

REVERSIBLE DOCUMENT MANIPULATING DEVICE

CROSS REFERENCE TO RELATED APPLICATION

The present application is a continuation of international PCT application No. PCT/SE99/00424, filed Mar. 18, 1999.

The present invention relates to a document handling device comprising a first endless conveyor, which is arranged to be intermittently driven in a first direction of feed and has drivers to fetch documents at document discharging stations and put them together into sheaves, which documents, downstream of the document discharging stations seen in the direction oL feed, are to be manipulated in sheaves at a first sheaf discharging station, such as a document manipulating unit, in which the sheaves of documents from the first conveyor are inserted into envelopes placed on a second endless conveyor, which is parallel to the first conveyor and driven synchronously therewith.

Such document handling devices are well known and are marketed by several manufacturers. They are used by, for example, insurance companies and banks in order to send documents packed in envelopes, such as insurance statements or statements of account with enclosures, to a large number of customers. However, they are also used more and more frequently by authorities and advertising agencies for dispatches being personally or generally addressed and packed in envelopes.

Especially authorities and advertising agencies sometimes wish to choose some other type of cover, for instance, a plastic sheeting or a folder, instead of an envelope. Then the normal solution has been either a completely manual handling of documents or the operation of a document handling device at a reduced speed, thereby permitting sheaves of documents to be fed without envelopes through the document manipulating unit for the purpose of conveniently taking care of the sheaves of documents after this unit, which have been put together by the document handling device. It is necessary to apply a reduced speed, especially because of requisite lateral movement from the first conveyor to the parallel second conveyor, but when the handled documents, which have been put together into sheaves, are of different sizes, there is a great probability of functional troubles after all. Nor is a satisfactory result achieved when handling documents of the same size since the discharge from the document manipulating unit generally is effected by a gripper, which may leave undesirable marks on the handled sheaves of documents.

In view of that stated above, the object of the invention is to provide a document handling device, which, apart from ordinary document manipulating at a relatively high speed and in a reliable way, can be used at the same high speed and with the same reliability for handling of sheaves of documents in other ways, for instance, for coating with plastics or stapling of such sheaves.

According to the invention, this object is achieved by a document handling device of the type mentioned by way of introduction by the first conveyor being intermittently drivable also in a second direction opposite to said first direction of feed and by a sheaf discharging station, such as a stapling or plastics coating unit, being arranged upstream of the document discharging stations seen in said first direction of feed.

The one skilled in the art realises that the relatively simple step of changing the direction of feed of the first conveyor permits the first sheaf discharging station to be circumvented, which may be, for instance, a document manipulating unit which may cause problems in some other type of document handling other than putting documents into envelopes. Besides, the one skilled in the art realises that the possible reversal of the direction of feed after all makes it possible to use the document discharging stations, and thus to feed sheaves of documents, which have been put together in a desired way, to a second sheaf discharging station, such as a stapling or plastics coating unit.

The two conveyors are preferably driven by one and the same motor, which is arranged to rotate in only one direction of rotation, and the direction of feed of the first conveyor is reversed by means of a gear unit. The use of one and the same motor means great advantages in respect of the synchronisation of the units included and, moreover, it does not constitute any problem at all for the one skilled in the art to carry out the desired reversal of the direction of feed by a conveniently selected gear unit.

The gear unit suitably comprises a drive shaft, which is driven by the motor and which drives on the one hand a first angular gear, the output shaft of which is arranged to drive the first conveyor in said first direction of feed and, on the other hand, a second angular gear arranged-to drive the first conveyor in said second direction of feed, the direction of feed being selectable by means of a clutch at each angular gear, the clutches being synchronised with each other so that engagement of one of them automatically brings about disengagement of the other. It will be appreciated that angular gears with conveniently placed gear wheels allow a simple change of direction and that there are several different types of suitable clutches for the desired automatic engagement and disengagement.

The output shaft of the first angular gear is preferably arranged to be driven together with the second conveyor, and the clutch of the first angular gear acts on a sleeve which is rotatably mounted on the output shaft of said angular gear and by which the first conveyor is drivable. This solution enables the driving of the first angular gear together with the second conveyor permanently and independently of the setting of the clutch. Furthermore, it will be appreciated that the document discharging stations also are conveniently driven together with the first angular gear.

A very simple solution is achieved if the clutch of the second angular gear is allowed to act on a sleeve which is rotatably mounted on the output shaft of the angular gear, and on which a first chain wheel is non-rotatably mounted in order to drive a second chain wheel by means of a chain, the chain wheel being non-rotatably mounted on the sleeve on the output shaft of the first angular gear. One of the great advantages of this solution is that it enables the use of the same conveyor whether it is mounted in a document handling device according to the invention, or in a traditional document handling device of the document manipulating device type.

Finally, it will be appreciated that the first and the second conveyor suitably are chain conveyors, which in connection with document manipulating devices constitutes the most common solution.

A preferred embodiment of the invention will be described in more detail below with reference to the accompanying drawings, in which.

Figure 1:
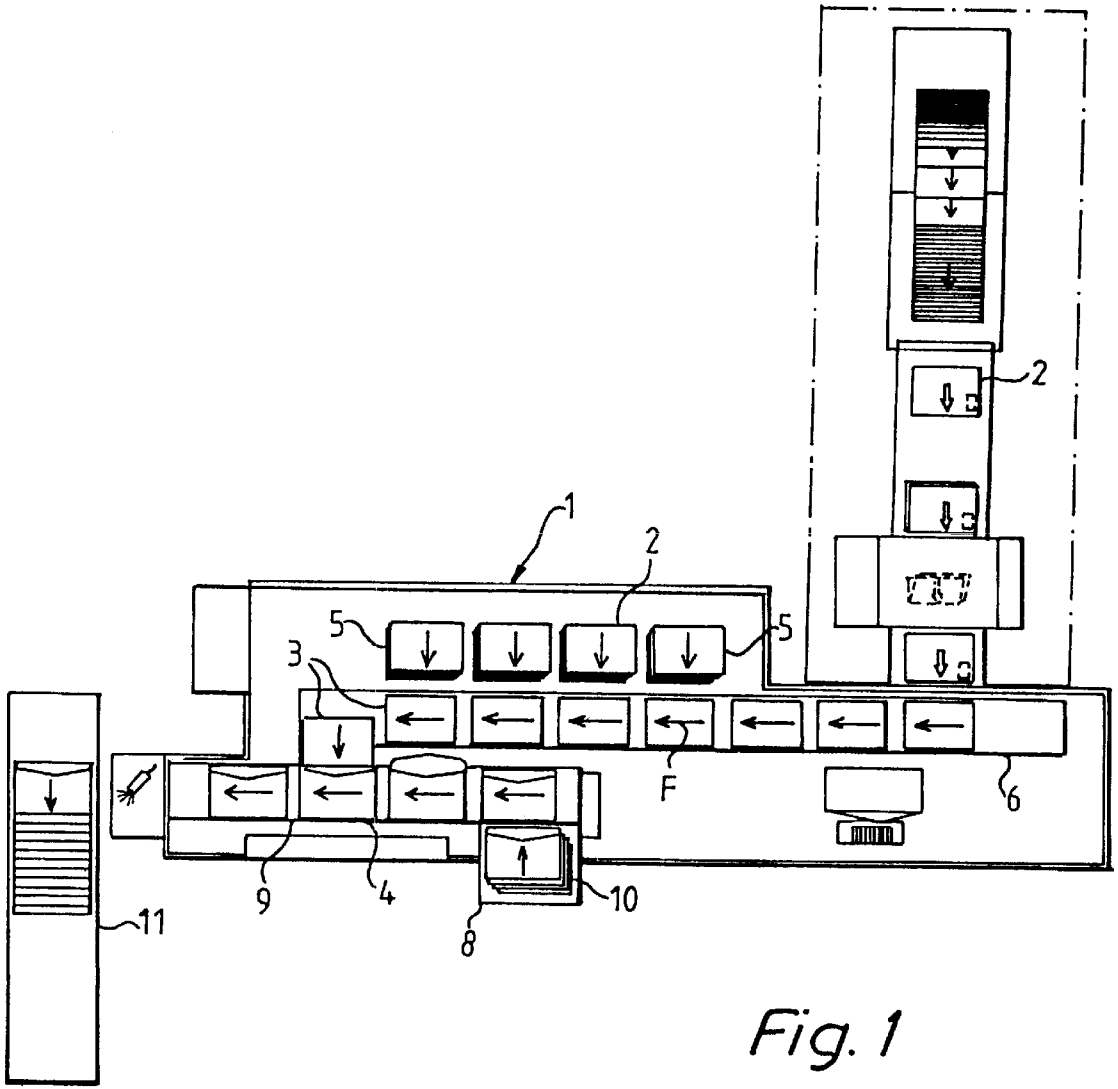
FIG. 1 is a schematic plan view and shows a known document manipulating device.

The document manipulating device 1 shown in FIG. 1 is intended for picking and collection of documents 2, such as separate sheets or thin printed matter. After collection the device 1 automatically inserts a collected sheaf 3 into an envelope 4 intended therefore. The document manipulating device 1 operates by means of vacuum and mechanical grippers and drivers. It comprises a number of document discharging stations 5 out of which a document 2 is picked by being separated from superposed documents by means of a suction cup. After the separation, a mechanical gripper controlled by a cam enters in order to embrace the document with jaws and pull it out of the document discharging station 5. When the gripper moves backwards the jaws open and the document 2 is then placed on a first conveyor 6. The conveyor 6 is a chain conveyor, which has drivers for clocked or intermittent feed of documents 2 and sheaves of documents 3. The clocking is performed by a step gear in such a way that documents 3 belonging together but coming from the different document discharging stations 5 are collected between the drivers of the conveyor 6. The described motion is repeated cyclically at a speed of up to 7000 cycles per hour.

The documents that are thus put together into sheaves of documents 3 are fed to a document manipulating unit 8, which is driven synchronously with the document discharging stations 5 and the first conveyor 6. In the document manipulating unit 8, a second conveyor 9 is included, which runs parallel to the first conveyor 6 and feeds, synchronously therewith, open envelopes 4. When the sheaf of documents 3 has reached the end of the first conveyor 6, it is moved sideways by drivers into a waiting envelope 4, which is held in an open position by suction cups. As soon as the sheaf of documents has been fed into the envelope 4, a new envelope 4 and a new sheaf of documents 3 are advanced, and the filled envelope is fed out of the device.

The document manipulating device 1 is driven by a frequency-controlled electric motor, which via a dividing gear, for instance via chain wheels and chains, drives grippers, cams for controlling the function of suction cups etc. At the same time the motor drives a step gear, which serves to operate the document discharging stations and to advance the first and the second conveyor 6, 9 step by step. Moreover, the motor may be used to feed empty envelopes from a stack 10 and to feed filled envelopes in a clock-controlled manner on to a third conveyor 11. The first and the second conveyor 6, 9 are chain conveyors and are positively guided in the direction of feed and cannot be reversed without causing damage.

Figure 2:
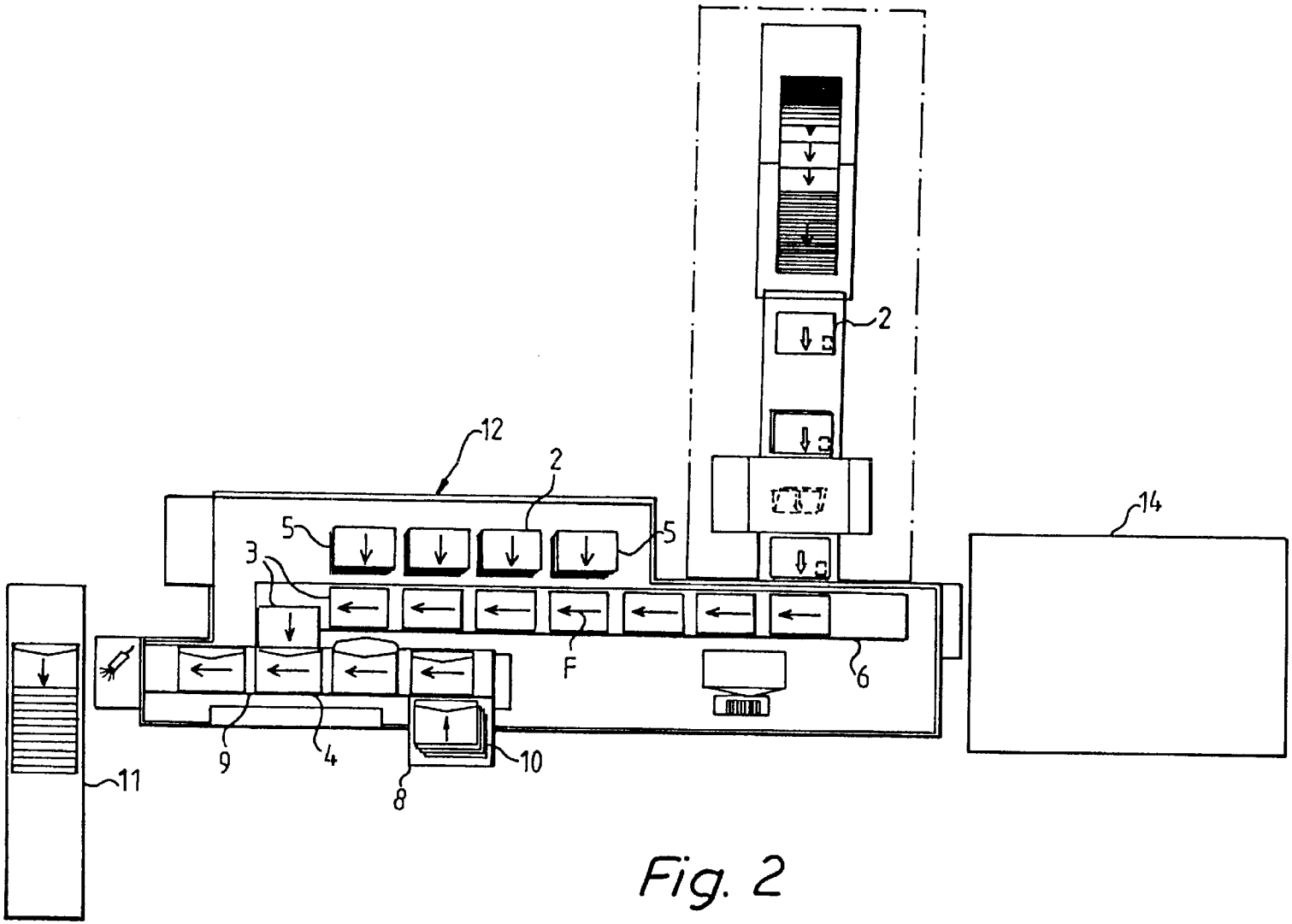
FIG. 2 is a schematic plan view and shows a document handling device according to the invention in connection with the manipulating of documents.
Figure 3:
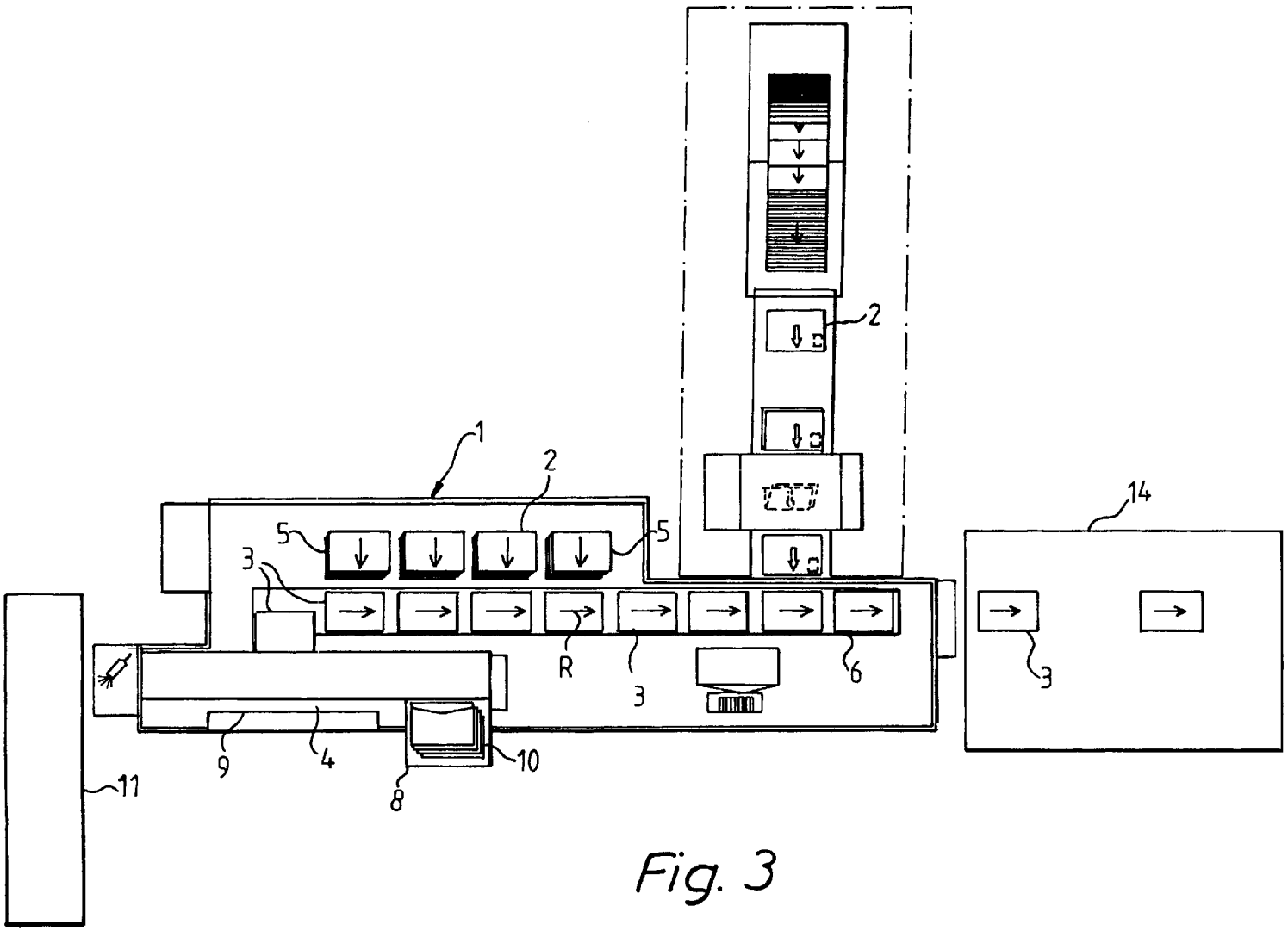
FIG. 3 is a schematic plan view and shows the document handling device according to the invention in connection with, for instance, coating of documents with plastics.

FIGS. 2 and 3 show a device, which to a large extent is identical to the one shown in FIG. 1. Identical parts are thus not described again and, moreover, the same reference numerals as in FIG. 1 are used.

What is new with the device shown in FIGS. 2 and 3 is that it is no longer a question of a regular document manipulating device 1 as in FIG. 1 but a much more comprehensive document handling device 12, the differing features of which will be described more in detail below and the advantages of which are that it can be used not only for conventional document manipulating but also for, for example, the following tasks:

- collection of sheaves of documents, which may be automatically transferred to a plastic sheeting device,
- collection of sheaves of documents, which may be automatically transferred to a stapling device for joining of, for example, compendia,
- collection of sheaves of documents for, for instance, back gluing,
- collection of documents, which may be automatically transferred to, for example, an ink jet printer, and
- feeding of documents to equipment for sealing.

The idea on which the invention is based and which allows the above-mentioned fields of application is the knowledge that a relatively easily achieved reversal of the first conveyor 6 with a maintained direction of feed of the other units included in a document manipulating device enables, as shown in FIG. 3, clock-controlled feeding out of documents 2 from the document discharging stations 5 on to the first conveyor 6 and then putting together documents 2 into sheaves of documents 3, which later may be fed to a unit for handling sheaves of documents 14 which is adapted, for instance, to coat the sheaves 3 with plastics.

Figure 4:
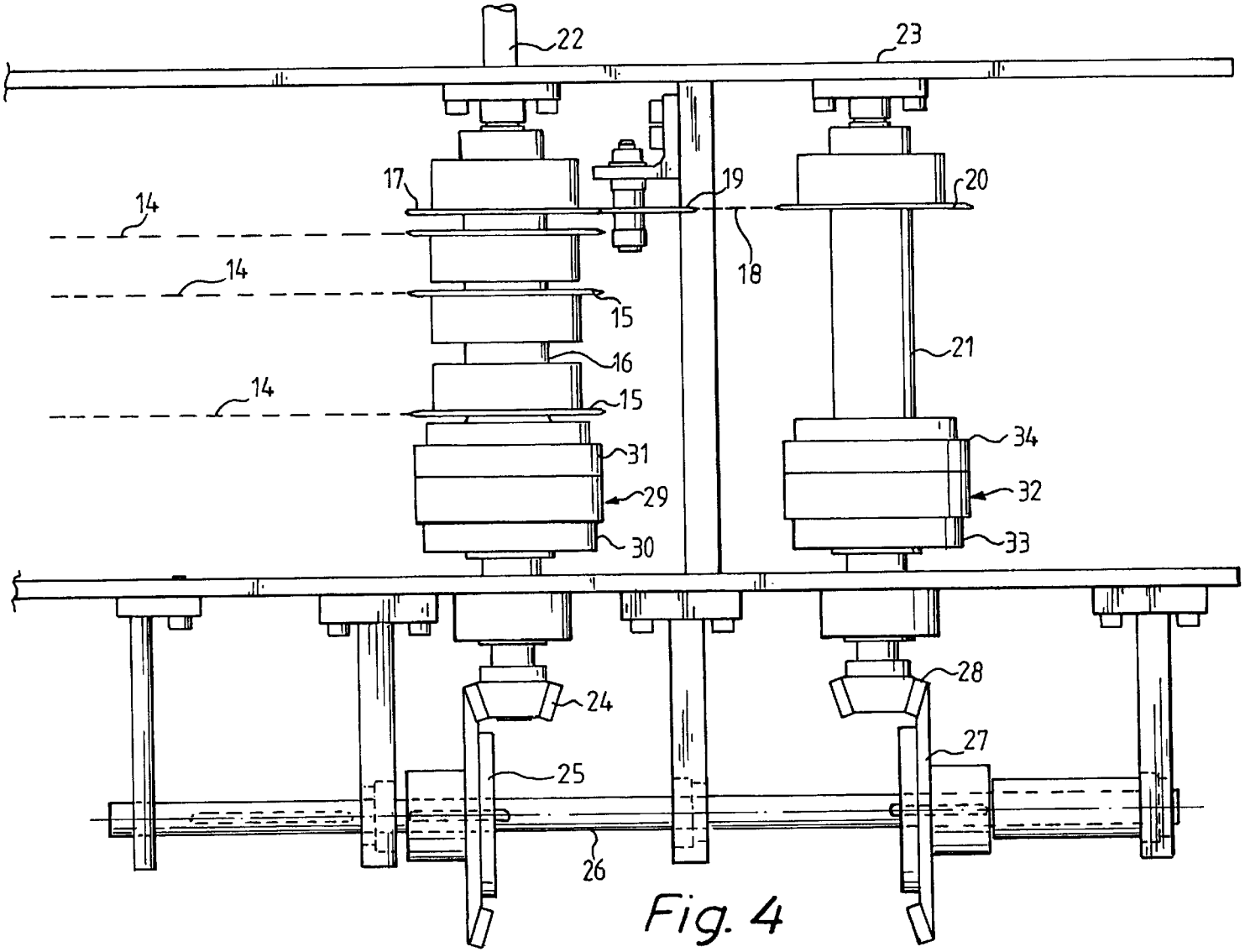
FIG. 4 is a plan view and shows a gear unit, which will be usable in the preferred embodiment of the invention and of which normally concealed details are indicated by dashed lines.
Figure 5:
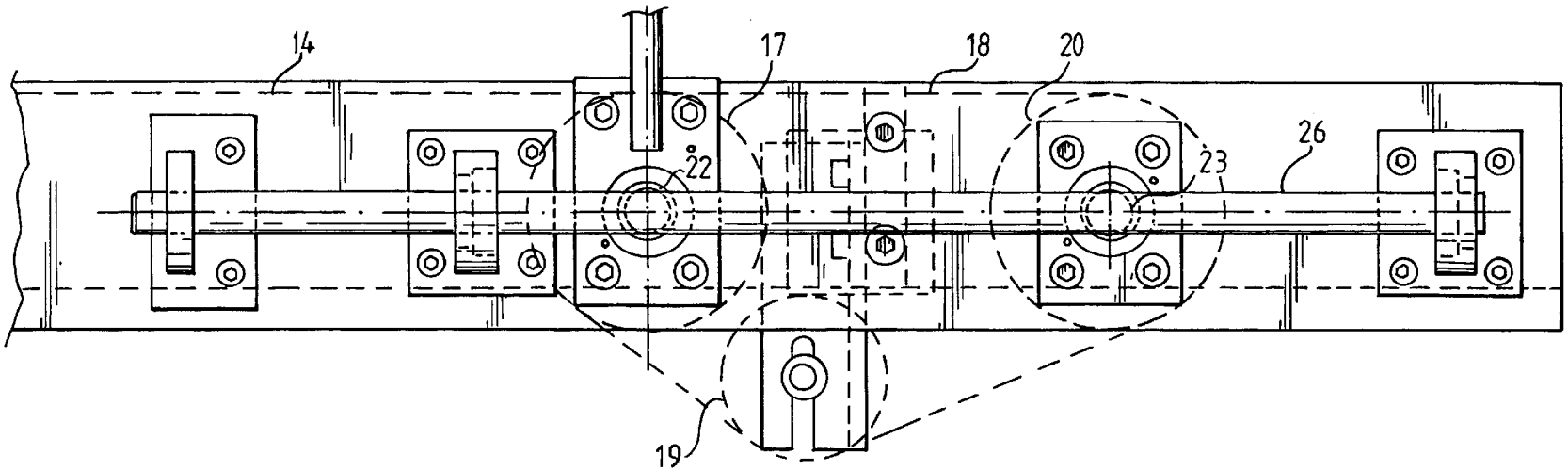
FIG. 5 is a side view of parts of the gear unit of FIG. 4.

FIGS. 4 and 5 illustrate a preferred drive solution, which will be described in more detail below.

In FIGS. 4 and 5, reference numeral 14 designates chains being included in the first conveyor 6. The chains 14 are driven by chain wheels 15, which are non-rotatably mounted on a sleeve 16. On the same sleeve 16 there is mounted another chain wheel 17, over which runs a drive chain 18, which via a chain tightener 19 is drawn round a chain wheel 20 non-rotatably mounted on a sleeve 21 which is parallel to the sleeve 16.

The sleeves 16, 21 are rotatably mounted on separate shafts 22, 23. The shaft 22, on which the sleeve 16 is mounted, is drivably connected to the other units of the document handling device 12, which are jointly driven, such as the document discharging stations 5 or the second conveyor 10. At its end, which is located at the bottom of FIG. 4, the shaft 22 has a bevel gear 24 engaging with a corresponding bevel gear 25 which is non-rotatably mounted on a shaft 26 perpendicular to the shaft 22. On the same shaft 26, a further bevel gear 27 is mounted; which engages with a bevel gear 28 mounted on the end of the shaft 23, which is located at the bottom of FIG. 4. Since in the arrangement shown in FIG. 4 the bevel gears 25 and 27 engage from the left and from the right, respectively, with their corresponding gear 24, 28, the two last-mentioned rotate in opposite directions. This is possible only owing to the rotatable mounting of the sleeves 16, 21 on the shafts 22, 23 as the chain wheels 17, 20 are non-rotatably connected to each other by means of the chain 18.

In order to achieve driving of the chains 14 by means of the chain wheels 15 on the sleeve 16, on the one hand a first clutch unit 29 is arranged, which has a first clutch half 30 non-rotatably connected to the shaft 22, and a second clutch half 31 non-rotatably connected to the sleeve 16, and, on the other, a second clutch unit 32 is arranged, which has a first clutch half 33 non-rotatably connected to the shaft 23, and a second clutch half 34 non-rotatably connected to the sleeve 21. There is a forced motion between the clutch units 29, 32, which causes, for instance, the chains 14 to be fed in the first direction of feed when the clutch halves 30, 31 are engaged with each other, and thus the sleeve 16 rotates synchronously with the drive shaft 22, and the clutch halves 33, 34 are disengaged from each other, and the sleeve 21 thus rotates freely on its shaft 23 rotating in the opposite direction. If the direction of feed of the chains 14 is reversed, the clutch halves 30, 31 are moved apart and the clutch halves 33, 34 are moved together, and the sleeve 21 with the chain wheel 20 mounted thereon rotates in the same direction as the shaft 23, and thus the sleeve 16 is driven via the chain wheel 17 in a direction opposite to the first direction of feed.

The one skilled in the art realises that a corresponding reversal within the scope of the appended claims can be achieved also in other ways than the one described and that the shaft 26, here described as a drive shaft, very well could be, for example, a shaft driven by the shaft 22.

What is claimed is:

1. A document handling device comprising a first endless conveyor (6), which is arranged to be intermittently driven in a first direction of feed (F) and has drivers to fetch documents (2) at document discharging stations (5) and put them together into sheaves (3), wherein the documents, downstream of the document discharging stations (5) seen in the direction of feed (F), are to be manipulated in sheaves at a first sheaf discharging station (8), in which the sheaves of documents (3) from the first conveyor (6) are inserted into envelopes (4) placed on a second endless conveyor (9), which is parallel to the first conveyor (6) and driven synchronously therewith, wherein the first conveyor (6) is intermittently drivable also in a second direction (R) opposite to said first direction of feed, and a second sheaf discharging station (14), is arranged upstream of the document discharging stations (5) seen in said first direction of feed (F), wherein the first conveyor (6) when driven in the second direction of feed (R) is arranged to fetch documents (2) at said document discharging stations (5) and to put these documents (2) together into the sheaves (3) of documents from the first conveyor (6), which are then handled in said second sheaf discharging station (14).

2. A document handling device as claimed in claim 1, wherein the two conveyors (6, 9) are driven by one and the same motor, which is arranged to rotate in only one direction of rotation, and the direction of feed of the first conveyor (6) is reversed by means of a gear unit.

3. A document handling device as claimed in claim 2, wherein the gear unit comprises a driven shaft (26), which is driven by the motor and which drives on the one hand a first angular gear (24, 25) having an output shaft (22) arranged to drive the first conveyor (6) in said first direction of feed (F) and, on the other hand, a second angular gear (27, 28) arranged to drive the first conveyor (6) in said second direction of feed (R), the direction of feed being selectable by means of a clutch (29, 32) at each angular gear, the clutches (29, 32) being synchronised with each other so that engagement of one of them automatically brings about disengagement of the other.

4. A document handling device as claimed in claim 3, wherein the output shaft (22) of the first angular gear is arranged to be driven together with the second conveyor (6), and the clutch (29) of the first angular gear acts on a sleeve (16) which is rotatably mounted on the output shaft (22) and by which the first conveyor (6) is drivable.

5. A document handling device as claimed in claim 4, wherein the document discharging stations (5) also are driven together with the first angular gear.

6. A document handling device as claimed in claim 4 or 5, wherein the clutch (32) of the second angular gear acts on a sleeve (21) which is rotatably mounted on the output shaft (23) of the angular gear and on which a first chain wheel (17) is non-rotatably mounted in order to drive a second chain wheel (20) by means of a chain (18), the first chain wheel being non-rotatably mounted on the sleeve (16) on the output shaft (22) of the first angular gear.

7. A document handling device as claimed in claim 1, wherein the first and the second conveyors (6, 9) are chain conveyors (14).

* * * * *